United States Patent [19]

Serracant Clermont

[11] 4,161,054

[45] Jul. 17, 1979

[54] METHOD FOR CONTINUOUSLY FULLING AND WORKING TEXTILE MATERIAL IN ROPE FORM

[76] Inventors: Jose M. Serracant Clermont, Calle Virgen de Gracia, 52 Sabadell, Spain

[21] Appl. No.: 856,159

[22] Filed: Nov. 30, 1977

Related U.S. Application Data

[63] Continuation of Ser. No. 677,846, Apr. 16, 1976, abandoned.

[30] Foreign Application Priority Data

Apr. 17, 1975 [ES] Spain ..... 436.895

[51] Int. Cl.[2] ..... D06C 17/00

[52] U.S. Cl. ..... 26/21; 28/264; 68/177

[58] Field of Search ..... 26/1, 18.5, 20, 21; 28/264; 68/177, 178

[56] References Cited

U.S. PATENT DOCUMENTS

| | | | |
|---|---|---|---|
| 395,202 | 12/1888 | Barette et al. | 26/21 |
| 472,900 | 4/1892 | Millet | 26/21 |
| 2,107,476 | 2/1938 | Frusher, Jr. | 26/21 |
| 2,442,742 | 6/1948 | Morrill | 26/21 |
| 2,908,044 | 10/1959 | Whitney | 28/266 |
| 3,058,167 | 10/1962 | Rainard et al. | 28/266 |
| 3,090,096 | 5/1963 | Schwartz | 28/264 |
| 3,096,558 | 7/1963 | Rainard et al. | 28/264 |
| 3,247,567 | 4/1966 | Hartman | 28/103 |
| 3,862,554 | 1/1975 | Amidon, Jr. | 68/177 X |

FOREIGN PATENT DOCUMENTS

| | | | |
|---|---|---|---|
| 2060526 | 6/1971 | France | 26/21 |
| 395493 | 7/1933 | United Kingdom | 26/21 |
| 1129204 | 10/1968 | United Kingdom | 26/18.5 |

*Primary Examiner*—Robert Mackey

*Attorney, Agent, or Firm*—Wenderoth, Lind & Ponack

[57] ABSTRACT

A textile material such as a fabric in an endless rope form is fed to a treatment enclosure, through which it is positively and continuously carried at a controlled speed lower than the speed at which it is fed into the enclosure, thereby causing the formation of folds in the textile material. Simultaneously, the folded textile material is continuously submitted to compression in a direction transverse to the longitudinal direction of its advancement through the enclosure.

6 Claims, 10 Drawing Figures

METHOD FOR CONTINUOUSLY FULLING AND WORKING TEXTILE MATERIAL IN ROPE FORM

This is a continuation of application Ser. No. 677,846, filed Apr. 16, 1976, now abandoned.

BACKGROUND OF THE INVENTION

In the textile industry it is normal, for the washing and fulling of fabrics in rope form, to treat the fabrics in the shape of compressed folds.

The known method used to form these folds in the fabric and to compress the folds comprises continuously advancing the fabric toward an enclosure wherein it is retained, so that the fabric is progressively folded within the enclosure, and applying pressure to the folds thus formed. To this end two driven rollers, which exert a pressure toward each other, feed the fabric into the inside of a retaining box, the cross-section of which is square or rectangular shaped. Generally, the bottom and two sides of the retaining box are fixedly mounted, and the top is hingedly mounted so that it can move toward or away from the discharge opening of the retaining box.

The hinged top is urged by a pressure device to close the discharge outlet of the retaining box while the retaining box is filled with fabric in the form of folds which are compressed by an amount which is a function of the pressure exerted thereon by the hinged top on the fabric and of the degree of adherence between the fabric and the feeding rollers.

In the known retaining boxes of the fabric fulling and washing machines, there have been introduced mechanical devices provided with reciprocating movements, arranged in the bottom part of the retaining box, in order to compress the folds of the fabric in combination with the pressure exerted by the top.

However, in all the known devices the discharge of the fabric out of the retaining box takes place in an intermittent manner, since the feeding rollers must, in addition to feeding the fabric, compress the fabric, and overcome the opposing force or friction of the retaining mechanisms in the retaining box in order to ensure the continuity of the operation.

Accordingly, it will be apparent that if the pressure exerted by the hinged part of the retaining box is increased, there comes a moment at which the compressing feeding rollers slip on the fabric, thereby harming or damaging the fabric by abrasion. Such slippage is relatively easily produced due to the fact that the treatment is carried out in a wet state.

If the advancement speed of the fabric is increased, the delays in the operation of the device between the filling phases, the compressing phases and the discharge phases from the retaining box take place within a shorter cycle, until a limit is reached whereat the hinged part oscillates so fast that there is no time for either the folding of the fabric or the required compression of the fabric to take place. There even comes a moment at which the hinged part stabilizes itself in a balanced position whereat it effects small continuing oscillations.

If the volumetric capacity of the retaining box is increased, the friction of the fabric during its passage through the retaining box is proportionally increased. This makes it necessary to reduce the retention pressure applied by the hinged part until there is reached a balance stage at which neither slippage nor defects in the fabric are produced.

If the pressure between the feeding rollers, the surface of which should be hard, is excessively increased, the likelihood of flaws being produced in the fabric due to the compression of the fabric is also increased.

SUMMARY OF THE INVENTION

The object of the present invention is to provide a method for forming folds, and compressing them, in a textile material continuously circulating through an enclosure, such method allowing the formation of the folds in a continuous and hence uniform manner to thereby provide a high degree of compression of the folds, to increase the speed of advancement of the textile material, and to reduce the danger of slippage by avoiding the need for the adherence or friction between the textile material and the feeding rollers to overcome the friction within the retaining box.

According to the method of the invention, this object is achieved by positively conveying the folds of the textile material while simultaneously compressing the folds.

Accordingly, the method of the invention essentially consists in reducing the speed of advancement of the textile material within the enclosure in relation to its feeding speed into the enclosure, carrying and guiding the textile material through the enclosure at a speed lower than the feeding speed, and at the same time submitting the moving textile material to a compression in a direction transverse to the longitudinal direction of advancement.

BRIEF DESCRIPTION OF THE DRAWINGS

In order to render easier the understanding of the method of the invention, such method is hereinafter described by comparing it with known methods, with reference to the accompanying drawings, wherein.

DETAILED DESCRIPTION OF THE INVENTION

Figure 1:
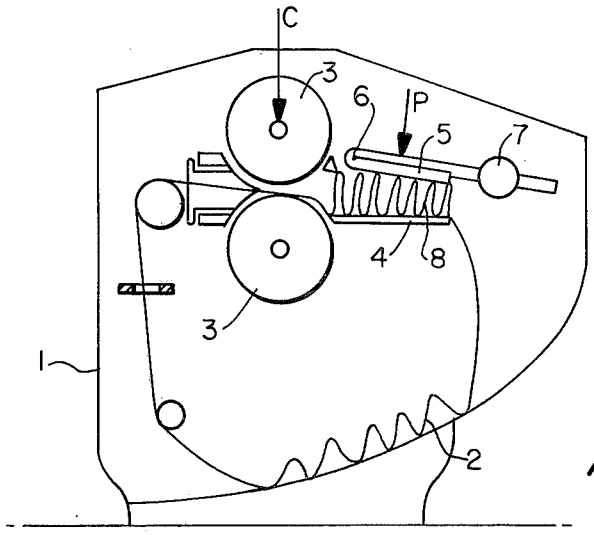
FIG. 1 PRIOR ART
FIG. 1 is a side view schematically illustrating a first known washing and fulling device.

In FIG. 1, there is shown a known fulling machine which comprises a box or vat 1 which may contain a treatment bath, and within which the fabric 2, which is arranged in an endless rope form, is accumulated. The fabric advances between two driven rollers 3 provided with means for exerting pressure C therebetween. Rollers 3 feed the fabric into a retaining box formed by a fixed lower wall 4 and two fixed side walls, thereby forming a type of canal, and by a top wall or lid 5 hinged at 6 so that it is able to close the discharge outlet of the retaining box. Lid 5 is provided with a weight 7, a spring or other means causing a pressure in the direction indicated by the arrow P. Thus the fabric, continuously fed by the rollers 3, is accumulated inside the retaining box thereby forming folds 8 which are compressed due to the effect of pressure P, until, after overcoming pressure P, the fabric is forced out of the retaining box and falls downwardly toward the bottom of the vat 1. As the retaining box is again closed due to the action of the weight 7, the fabric is thus again accumulated within the retaining box, and new folds 8 are formed.

Figure 2:
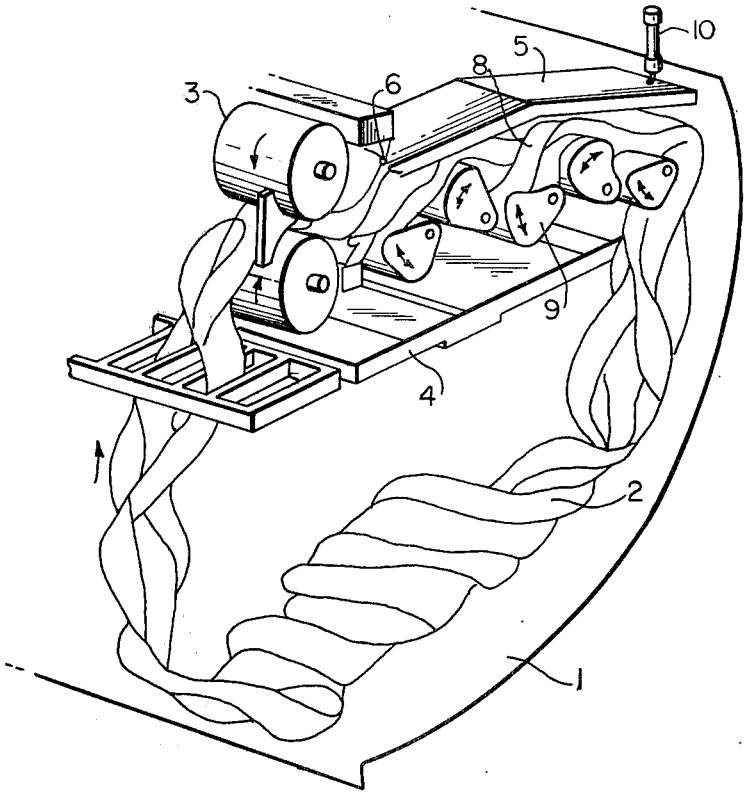
FIG. 2 PRIOR ART
FIG. 2 is a perspective view schematically illustrating a second known washing and fulling device.

In another known apparatus shown in FIG. 2, there are arranged in the lower part of the retaining box a set of eccentric rotary elements 9 which intermittently compress the folds 8 of the fabric against the hinged lid 5 which is pressed downwardly by the action of a spring 10.

Figure 3:
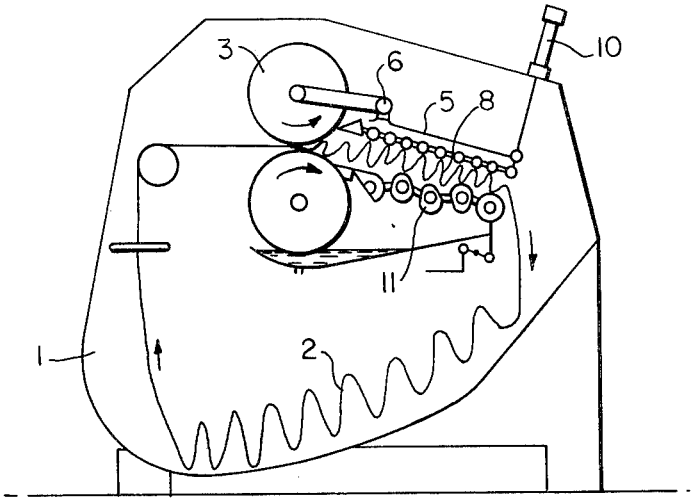
FIG. 3 PRIOR ART
FIG. 3 is a side view schematically illustrating a third known washing and fulling device.

FIG. 3 shows another known apparatus wherein the lower part of the retaining box is formed by a set of elements 11 provided with a reciprocating up and down movement, thereby also producing an intermittent compression in the folds 8 of the fabric against the hinged lid 5.

As will be seen, all these known devices operate according to the usual method wherein the fabric is accumulated in folds within the retaining box, and the thus formed folds are compressed until they issue out of the retaining box, whereafter the fabric is again retained within the retaining box. In this usual method of the advancing of the fabric along the retaining box, the formation of the folds and the compression of the folds take place in an intermittent manner, and the compressing feeding rollers 3 have to overcome the delaying action produced by the retaining box on the forward advancement of the fabric.

On the other hand, in accordance with the method of the invention, the textile material, such as a fabric arranged in rope form, is fed from the outlet of the feeding rollers at a uniform speed into an enclosure equivalent to a retaining box. The fabric is carried and guided in a positive and continuous manner through the enclosure at a controlled speed which is lower than the speed of the feeding rollers. The enclosure of the invention also determines the formation of folds in the fabric similar to the known method, but with the difference that these folds are formed and advanced in a continuous manner, and according to the invention the folds, while continuously advancing, are progressively compressed.

This simultaneous action of carrying and guiding as well as compressing the textile material may be achieved by means of a carrying and guiding device which is positively driven at a controlled speed and which is provided with a pressure applying means.

The carrying and guiding device may be at least two opposed conveyor belt assemblies, or two opposed assemblies of rows of driven rollers, or combinations of a conveyor belt assembly and an assembly of a row of driven rollers. At least one of these assemblies is hinged at a position adjacent the feeding rollers and is provided with weights, springs or other devices which exert a pressure between the two opposed assemblies. Thus, the two opposed carrying and guiding assembly systems of the invention replace two opposed fixed walls of the known retaining box of the fulling machines, and may correspond to the lower wall and top wall, or to the two sides walls of the known retaining box. Further, the opposed carrying and guiding assemblies may form all four walls of the enclosure.

Figure 4:
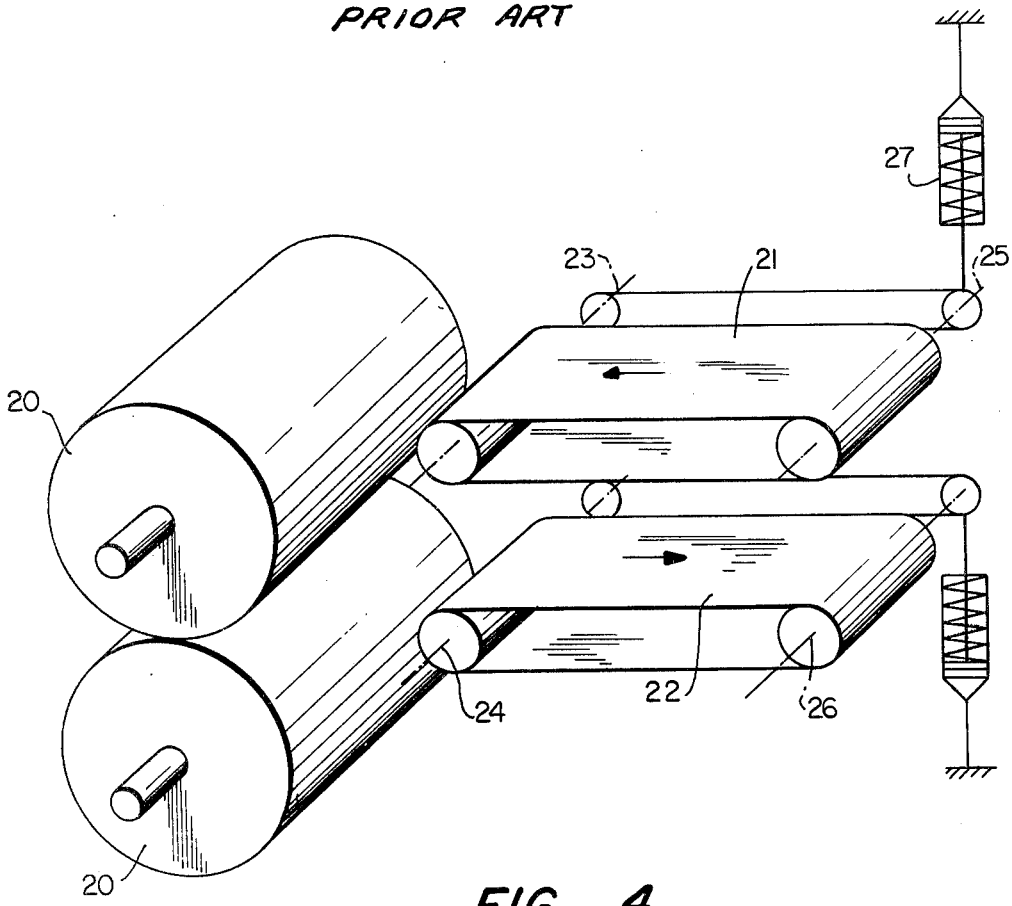
FIG. 4 is a perspective view schematically illustrating a first device for carrying out the method of the present invention.

Thus, the apparatus schematically shown in FIG. 4 includes two feeding rollers 20, at the outlet of which, for replacing the known retaining box, are arranged upper and lower driven conveyor belts 21 and 22, with the axes thereof parallel to the axes of the feeding rollers 20. The respective axes 23 and 24 of the conveyor belts which are adjacent to the feeding rollers 20 are fixedly mounted, whereas the respective opposed axes 25 and 26 are parallel and are displaceably mounted toward and away from each other by the action of respective springs 27, thereby causing the conveyor belts 21 and 22 to pivot about axes 23 and 24 and to exert pressure toward each other.

Figure 5:
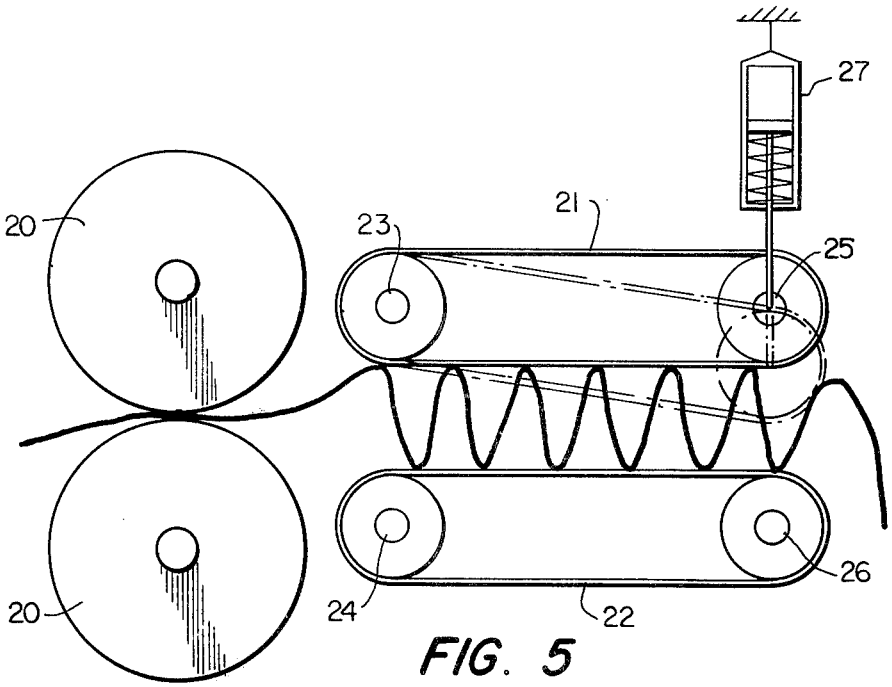
FIG. 5 is a side view schematically illustrating a second device for carrying out the method of the present invention.

However, the two axes of one of the conveyor belts, e.g. axes 24 and 26 of belt 22, may be fixedly mounted as shown in FIG. 5, wherein only the upper conveyor belt 21 is movable to exert pressure toward the lower conveyor belt 22.

Figure 6:
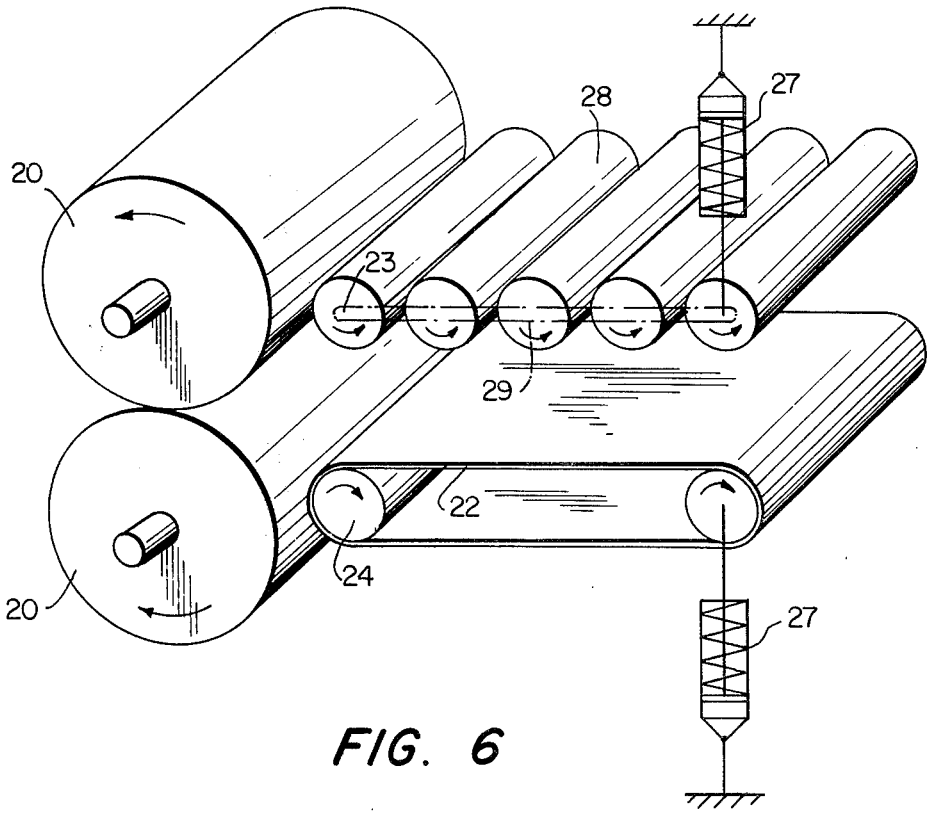
FIGS. 6 and 7 are views similar to FIG. 4 schematically illustrating third and fourth devices, respectively, for carrying out the method of the invention.
Figure 10:
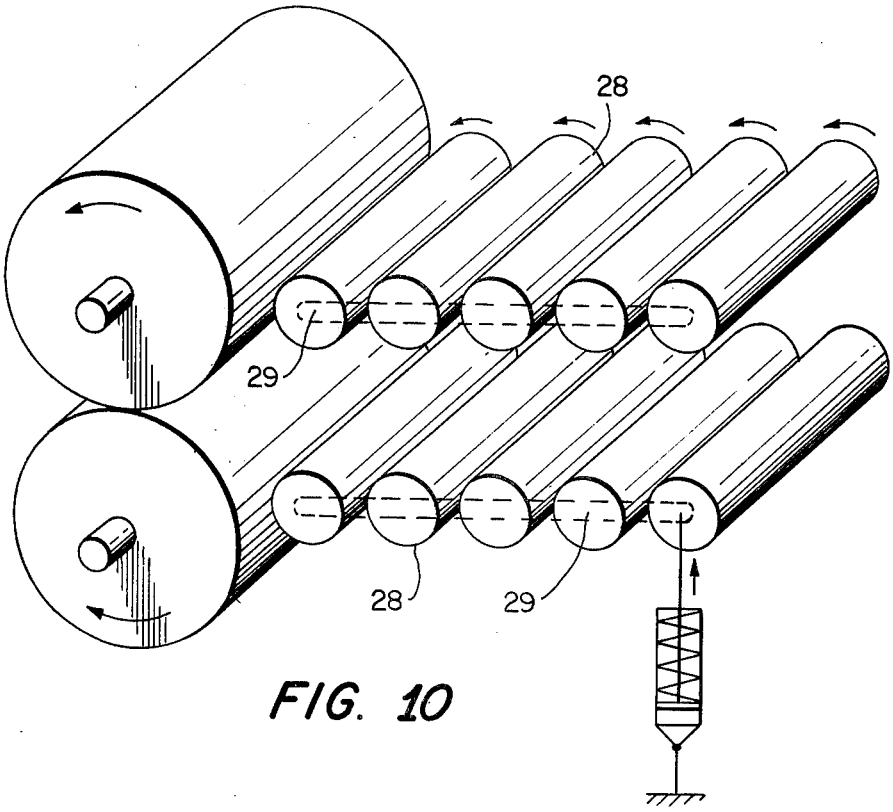
FIG. 10 is a perspective view schematically illustrating a fifth device for carrying out the method of the present invention.

Both of the conveyor belts as shown in FIG. 10, or only one of them as shown in FIG. 6, can be replaced by an assembly of driven rollers 28 mounted parallel on a common frame 29 which is hinged at the end 23 thereof adjacent to the feeding rollers 20, and which at the opposite end thereof is submitted to the action of spring 27.

Figure 7:
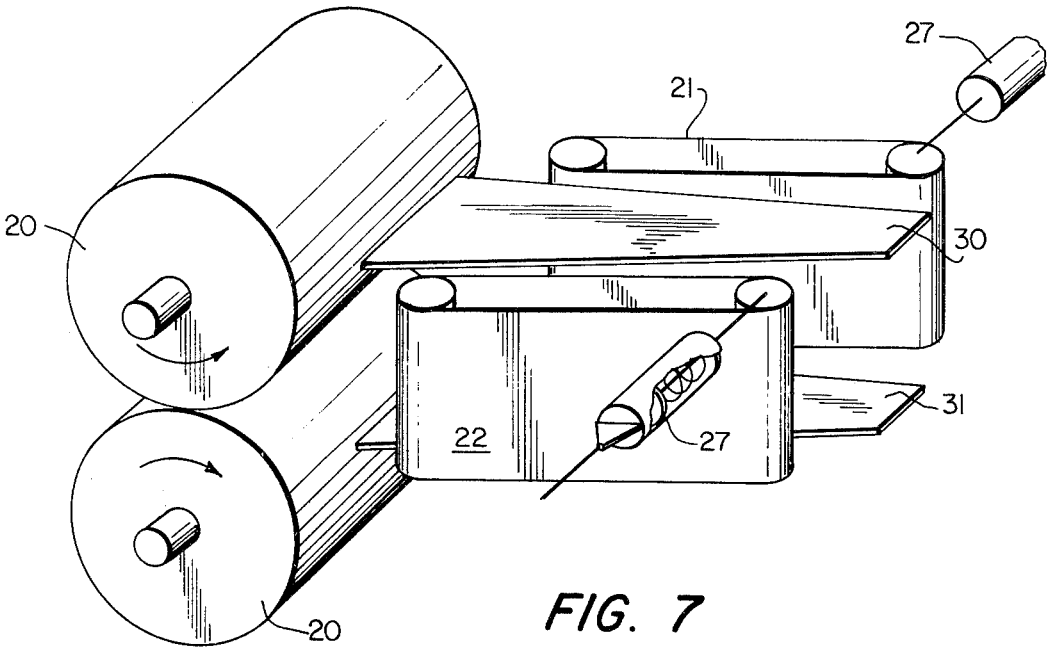

The same effect can be obtained by arranging the conveyor belts 21 and 22, or the roller assemblies 28, with the axes thereof extending in a direction perpendicular to the direction of the axes of the rollers 20, as shown in FIG. 7, with top and bottom walls 30 and 31 being fixedly arranged.

Figure 8:
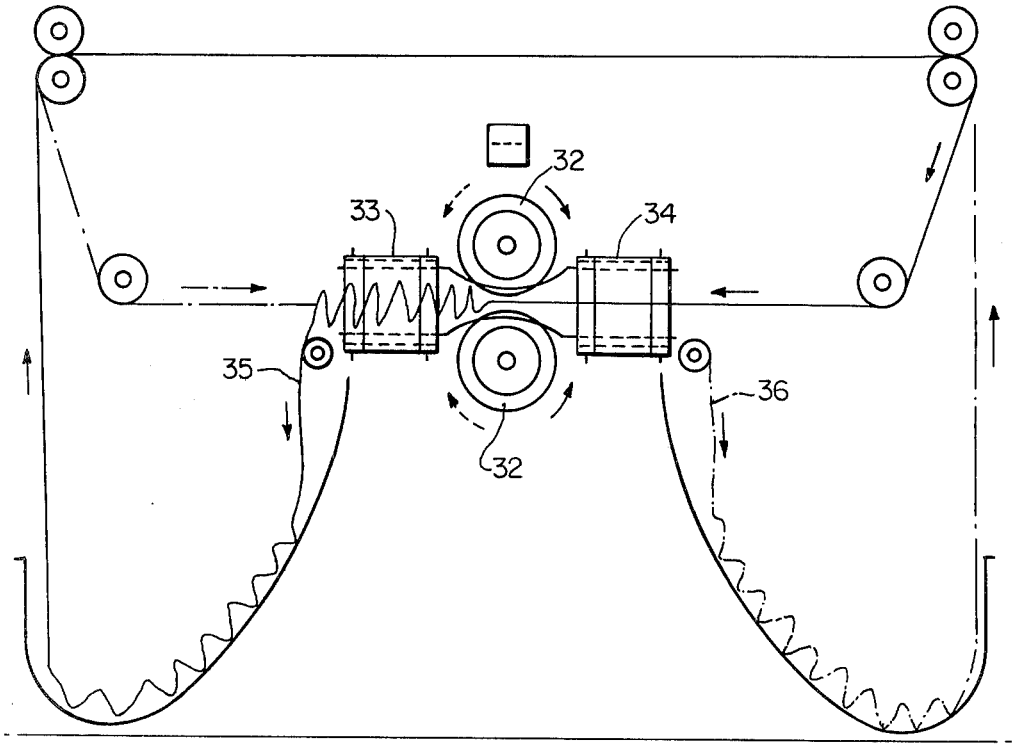
FIG. 8 is a side view schematically illustrating a device for carrying out the method of the present invention in a reversible manner.

Furthermore, the operation of the above described assemblies makes it possible to design fulling and washing machines wherein the direction of advancement of the textile material, and therefore the compression thereof, can periodically be reversed, for example, as shown in the apparatus of FIG. 8, which comprises a pair of feeding rollers 32 and two devices 33 and 34, which may be similar to any one of the devices shown in FIGS. 4 through 7 and 10, mounted on opposite sides of the rollers 32. The direction of rotation of feeding rollers 32 and of the conveyor belts or rollers of the devices 33 and 34 may be reversed, so that the textile material can be made to circulate in the direction indicated by the full line 35 when the device 33 is in operation while the pressure exerted by the device 34 is removed and remains inactive, and in the opposite direction as indicated by dashed line 36 when the device 34 is in operation and the device 33 remains inactive.

Figure 9:
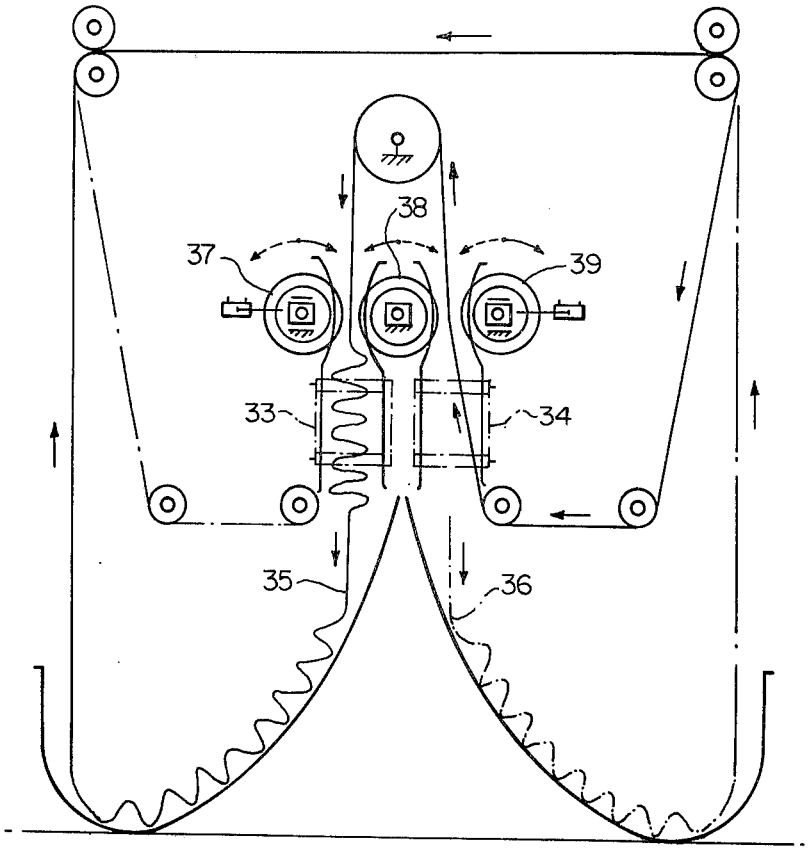
FIG. 9 is a side view schematically illustrating a device for carrying out the method of the present invention in a reversible and vertically aligned manner.

The devices 33 and 34 can also be disposed in such a way that the textile material passes through them in a vertical direction, as shown in FIG. 9, wherein the apparatus comprises three compressing feeding rollers 37, 38 and 39, so that the textile material, when circulating in the direction indicated by the full line 35, is first compressed between the rollers 38 and 39, thereafter passes between the rollers 37 and 38 which feed it into the device 33, and, when circulating in the direction indicated by the dashed line 36, is first compressed between the rollers 37 and 38 and then passes between the rollers 38 and 39 which feed it into the device 34.

As can be seen, the method of the invention makes it possible, due to the differential speed relation between the feeding rollers and the carrying and guiding conveyor belts or rollers, to form the folds in the textile material in a continuous and hence more uniform manner, to obtain a higher degree of compression in the folds, and to increase the processing speed of the textile material. Further, there is less danger of slippage between the textile material and the feeding rollers, since adherence between the feeding rollers and the textile material is not required to overcome friction within the retaining box, because the folds are positively carried forward while they are compressed. Thus, the overall work or effort required of the feeding rollers is reduced when the textile material is passed on to the fold forming device.

Furthermore, during a fabric fulling operation, when the greater possible regular degree of fulling in the least possible time is desired, the method of the present invention makes it possible to considerably increase the advancing speed of the fabric, hence thereby also increasing, in proportion to the square of the speed, the active force in the fabric which produces collision among the fibers. Accordingly, there is thereby obtained greater rapidity and uniformity of the fulling operation.

What I claim is:

1. A method for continuously pleating, compressing and fulling textile material in rope form, said method comprising:

providing an elongated enclosure having at least two opposite walls thereof defined by movable members, with each of said movable members comprising a plurality of separate surfaces spaced from each other longitudinally of said enclosure;

continuously introducing textile material in endless rope form into a first end of said enclosure at a first speed;

driving all of said separate surfaces of each of said movable members at a second speed slower than said first speed, thereby forming said textile material into folds, and continuously and positively contacting said folds with all of said separate surfaces of each of said movable members which move in the same direction as said folds, thereby continuously guiding and carrying said folds through said enclosure at said second speed;

simultaneously urging all of said separate surfaces of at least one of said movable members toward said folds in a direction transverse to the direction of movement of said folds through said enclosure, thereby compressing said folds;

continuously discharging said folds at a uniform rate from a second end of said enclosure; and repeatedly passing said textile material through said enclosure, thereby repeatedly folding and compressing said textile material.

2. A method as claimed in claim 1, wherein said movable members comprise assemblies of driven rollers, and said separate surfaces comprise outer surfaces of said rollers which positively contact and carry said folds through said enclosure.

3. A method as claimed in claim 1, wherein said members extend through substantially the entire length of said enclosure, at least one of said members being pivoted at an end thereof adjacent the said first end of said enclosure, said step of urging comprising pivoting said one member toward said folds and thereby compressing said folds throughout substantially the entire length of said enclosure.

4. A method as claimed in claim 3, wherein both said members of opposite walls are pivoted about ends thereof adjacent said first end of said enclosure, and both of said members are pivoted to compress said folds throughout substantially the entire length of said enclosure.

5. A method as claimed in claim 1, further comprising providing two said enclosures, and alternately passing said textile material through said enclosures in a first direction while folding and compressing said material in a first said enclosure and maintaining the second said enclosure inactive, and then passing said textile material through said enclosures in a second opposite direction while folding and compressing said material in said second enclosure and maintaining said first enclosure inactive.

6. A method as claimed in claim 1, further comprising continuously passing said textile material, after discharge thereof from said enclosure, through a washing and treatment bath.

* * * * *